US007409734B2

(12) United States Patent
Benedict et al.

(10) Patent No.: US 7,409,734 B2
(45) Date of Patent: Aug. 12, 2008

(54) PNEUMATICALLY POWERED LIFT AMBULANCE COT

(75) Inventors: William H. Benedict, Jamestown, OH (US); Robert C. Chinn, Atlanta, GA (US); Warren D. Sutton, Sr., Wathena, KS (US)

(73) Assignee: Ferno-Washington, Inc., Wilmington, DE (US)

( * ) Notice: Subject to any disclaimer, the term of this patent is extended or adjusted under 35 U.S.C. 154(b) by 118 days.

(21) Appl. No.: 10/982,483

(22) Filed: Nov. 5, 2004

(65) Prior Publication Data

US 2005/0120480 A1 Jun. 9, 2005

Related U.S. Application Data

(60) Provisional application No. 60/517,582, filed on Nov. 5, 2003.

(51) Int. Cl.
*A61G 1/00* (2006.01)
*A61G 7/012* (2006.01)

(52) U.S. Cl. ..... 5/611; 296/20

(58) Field of Classification Search ..... 5/611, 5/600, 620, 81.1 R, 86.1; 296/20
See application file for complete search history.

(56) References Cited

U.S. PATENT DOCUMENTS

| | | | |
|---|---|---|---|
| 3,174,722 | A | 3/1965 | Alm |
| 3,203,670 | A | 8/1965 | Farris |
| 4,078,269 | A | 3/1978 | Weipert |
| 4,097,941 | A | 7/1978 | Merkel |
| 4,159,822 | A | 7/1979 | Ota et al. |
| 4,323,141 | A | 4/1982 | Ragan et al. |
| 5,022,105 | A | 6/1991 | Catoe |
| 5,135,350 | A | 8/1992 | Eelman et al. |
| 5,271,113 | A | 12/1993 | White |
| 5,365,622 | A | 11/1994 | Schirmer |
| 5,495,914 | A | 3/1996 | DiMucci et al. |
| 6,654,973 | B2 | 12/2003 | Van Den Heuvel et al. |
| 6,729,667 | B2 | 5/2004 | Henderson et al. |
| 6,976,696 | B2 | 12/2005 | O'Krangley et al. |
| 2004/0133981 | A1 | 7/2004 | Walkingshaw |

*Primary Examiner*—Alexander Grosz
(74) *Attorney, Agent, or Firm*—Dinsmore & Shohl LLP

(57) ABSTRACT

A collapsible pneumatically operated ambulance cot having a support frame, a wheeled base, a support mechanism disposed therebetween, and a lift mechanism for pneumatically moving the upper frame relative to the lower frame is disclosed. The lift mechanism permits a single attendant to raise the cot from a lowered position to a raised position, and an infinite number of positions therebetween, and to raise the wheeled base relative to the support frame to situate the cot onto an elevated surface such as the transport deck of an ambulance.

18 Claims, 6 Drawing Sheets

PNEUMATICALLY POWERED LIFT AMBULANCE COT

CROSS-REFERENCE TO RELATED APPLICATIONS

This application claims the benefit of U.S. Provisional Application Ser. No. 60/517,582, filed Nov. 5, 2003.

FIELD OF THE INVENTION

This invention relates to ambulance cots and more particularly to ambulance cots having pneumatically, operated collapsible frame structures to facilitate manual operation by a single operator from the ground into an ambulance.

BACKGROUND OF THE INVENTION

In order to situate a conventional non-powered ambulance cot into the back of an ambulance, two or more attendants often must lift the cot from a relatively low height of approximately 15 cm from the ground to a height of almost 1 meter. Unfortunately, lifting or raising a loaded ambulance cot from this low height increases the risk to these attendants obtaining a back injury or exacerbating an existing one. Accordingly, providing a power lift ambulance cot for emergency medical services and ambulance-related services that reduces the physical strain of raising and lowering a loaded ambulance cot is desirable. Such a powered cot would reduce work related injuries and reduce the amount of lost work time as well as therapeutic costs.

SUMMARY OF THE INVENTION

The present invention meets the above-mentioned needs by providing a pneumatic lift mechanism to an ambulance cot which will be used to assume all or most of the effort required to lift and/or lower the cot and patient carried thereon.

In one embodiment, a pneumatically powered lift ambulance cot comprising a wheeled base having a first slide member slidably supported by a longitudinally extending lower guide is disclosed. A support frame has a second slide member slidably supported by a longitudinally extending upper guide, and is disposed above the wheeled base. A support mechanism, which supports the support frame relative to the wheeled base, is pivotally connected to the support frame, the wheeled base, the first slide member, and the second slide member. A pneumatic lift mechanism is pivotally mounted at a first end to the first slide member, and at a second end to the support mechanism. An air cylinder is releasably mounted to the cot to supply air pressure to the pneumatic lift mechanism in order to assist relative movement between the support frame and the wheeled base. An arresting device releasably arrests movement of the second slide member along the upper guide to permit adjustments of a vertical position of the support frame with respect to the base with or without assistance from the linear actuator.

In another embodiment, a pneumatically powered lift ambulance cot comprising a wheeled base having a first slide member slidably supported by a longitudinally extending lower guide is disclosed. A support frame has a second slide member slidably supported by a longitudinally extending upper guide, and is disposed above the wheeled base. A support mechanism, which supports the support frame relative to the wheeled base, includes a first pair of elongated legs having a first end pivotally connected to the first slide member and a second end pivotally connected to the support frame. A second pair of elongated legs has a first end pivotally connected to the base and a second end pivotally connected to the second slide member. Respective ones of the first and second pairs of elongated legs are pivotally connected to one another each by a pivot connection. A pneumatically powered linear actuator is pivotally mounted at a first end to the first slide member and at a second end to the first pair of elongated legs above each pivot connection. An arresting device releasably arrests movement of the second slide member along the upper guide to permit adjustments of a vertical position of the support frame with respect to the base with or without assistance from the linear actuator.

These and other features and advantages of the invention will be more fully understood from the following description of a preferred embodiment of the invention taken together with the accompanying drawings. It is noted that the scope of the claims is defined by the recitations therein and not by the specific discussion of features and advantages set forth in the present description.

BRIEF DESCRIPTION OF THE DRAWINGS

The following detailed description of the embodiments of the present invention can be best understood when read in conjunction with the following drawings, where like structure is indicated with like reference numerals and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

DETAILED DESCRIPTION

Figure 1:
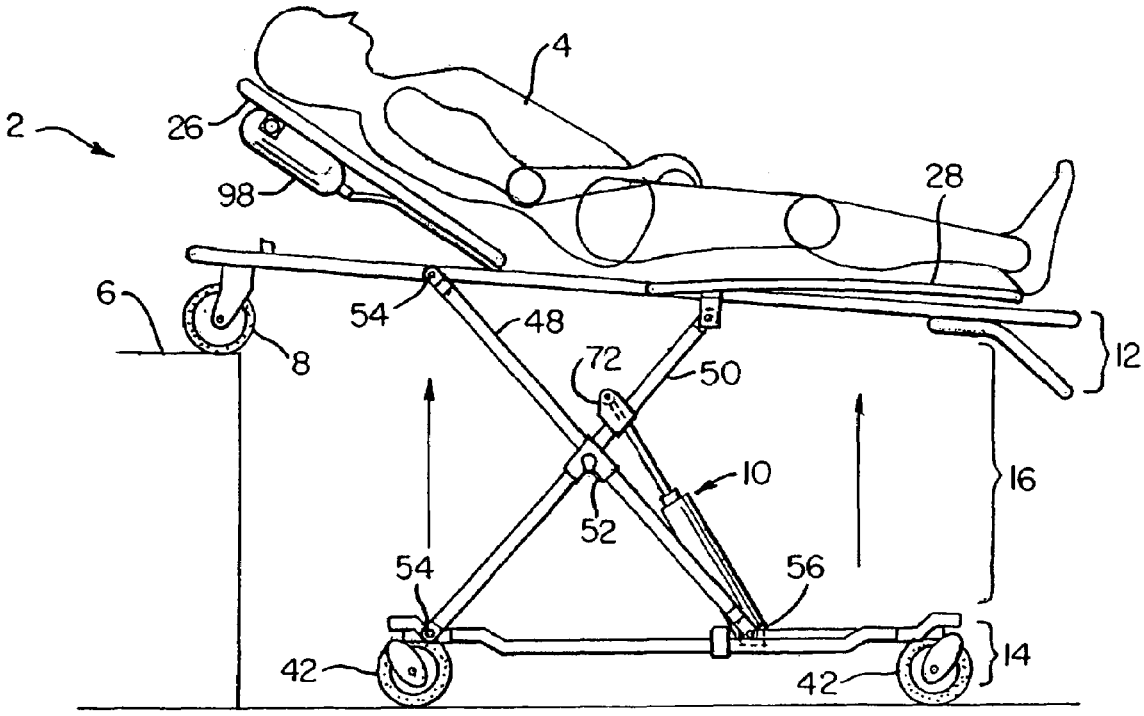
FIG. 1 is a schematic side view of a cot according to the invention situated in a fully elevated position.
Figure 2:
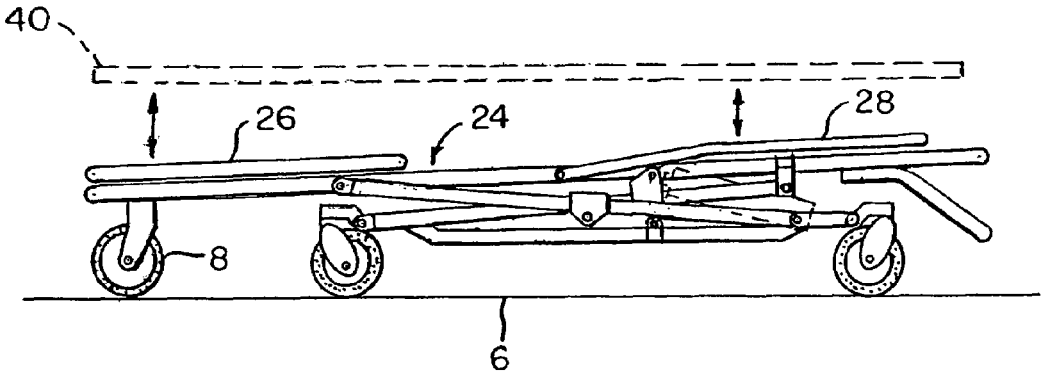
FIG. 2 is a schematic side view of a cot according to the invention in a fully lowered position.
Figure 3:
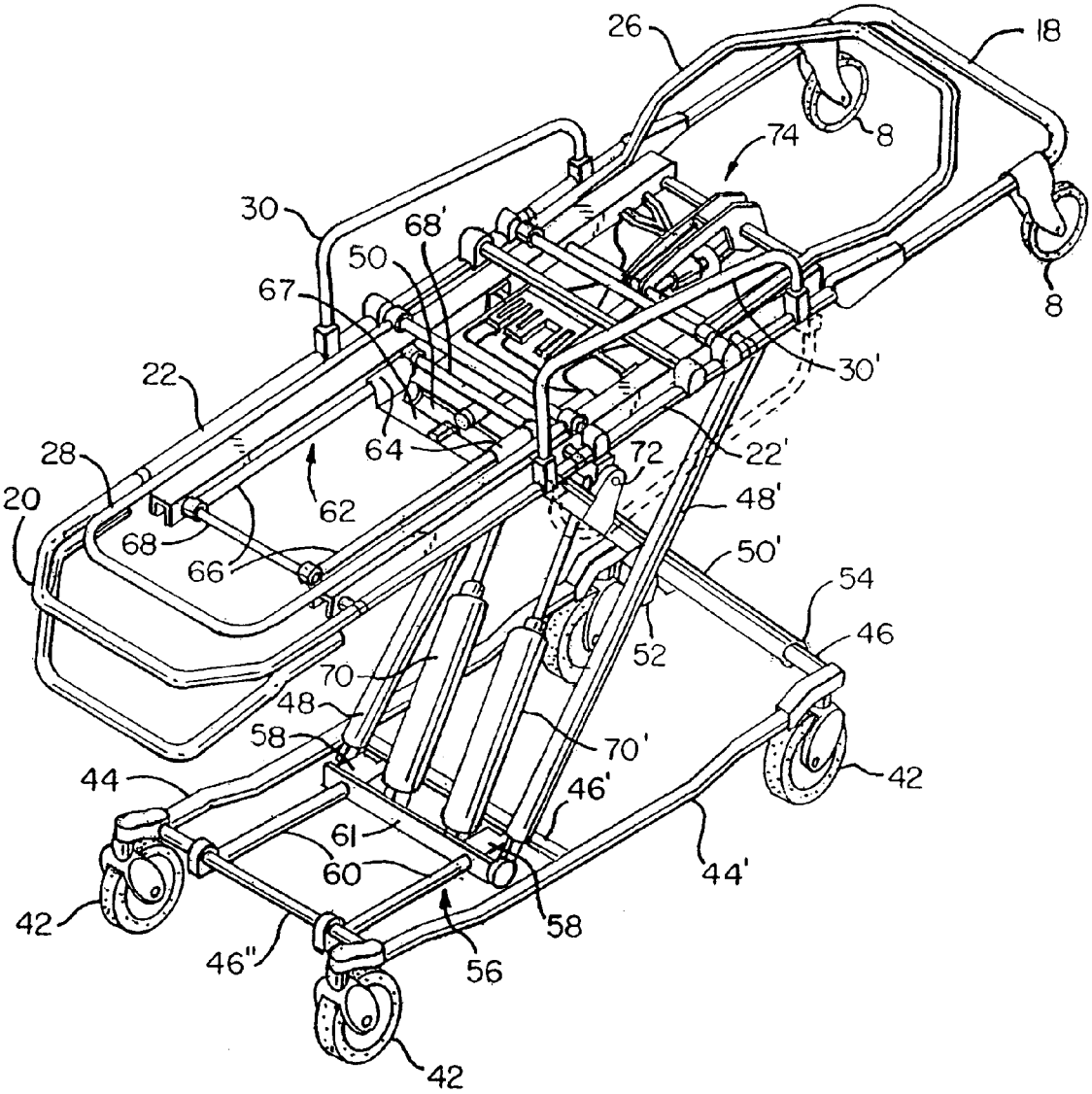
FIG. 3 is a schematic top view of the undercarriage of a cot according to the invention.

With reference to FIGS. 1-3, a retractable ambulance cot according to one embodiment of this invention is shown generally as 2. Upon the cot 2 a patient 4 may be supported, and conveniently loaded onto an elevated surface 6, such as for example, the transport bay of an ambulance. Referring to FIG. 1, the cot 2 is illustrated in an elevated position. It is to be appreciated that a single attendant can hold and manipulate the trailing end of the cot 2 in the elevated position in order to rest loading wheels 8 provided at the leading end of the cot onto the elevated surface 6. Operation of an associated pneumatic lift mechanism shown generally as 10 of the cot 2 as described herein in a later section, causes the undercarriage to be pneumatically raised to the level of the elevated surface 6 allowing the attendant to transfer the cot 2 thereon in the lowered position as depicted by FIG. 2. The pneumatic lift mechanism 10 also pneumatically raises the cot 2 from the lowered position to the raised position, and an infinite number of positions therebetween. Venting of the pneumatic lift mechanism 10 is used to cause the cot 2 to be lowered from the raised position to the lowered position, and an infinite number of positions therebetween.

The cot 2 comprises an upper frame shown generally as 12, a wheeled base or lower frame shown generally as 14, and a support mechanism shown generally as 16 disposed therebetween for supporting the upper frame 12 relative to the lower frame 14. The upper frame 12 is generally rectangular, and in the illustrated embodiment shown by FIG. 3, comprises a leading end frame member 18, a trailing end frame member 20, and a pair of opposed, longitudinally extending side frame members 22, 22'. The frame members 18, 20, 22, and 22' are a tubular material, such as metal, laminate, plastics, or combinations thereof, and are connected together in a conventional manner.

In the illustrated embodiment, the leading end frame member 18 is rotatably coupled to the opposed side frame members 22, 22' and is a drop frame, such as the type disclosed by U.S. Pat. No. 6,701,454, commonly assigned to Ferno Washington, Inc., and the disclosure of which is herein fully incorporated by reference. The loading wheels 8 are provided to the leading end frame member 18.

In one embodiment, the upper frame 12 includes a patient bed shown generally as 24 in FIG. 2 upon which the patient 4 rests. The patient bed 24 includes raisable back and leg rests 26 and 28, respectively. Attached to the back surface of the back rest 26 is a pneumatic pressure vessel or air tank 98 which stores compressed air required to operate the pneumatic lift mechanism 10 according to the invention. Air tank 98 is rechargeable without being removed from the cot via either an air compressor or a larger air cylinder. Preliminary tests indicate that air tank 98 when filled to about 2500 psi (17 MPa) provides enough air to lift the patient 4 and raise the lower frame 14 relative to the upper frame 12 about 15 times. The number of cycles can be increased by filling air tank 98 to its full capacity of about 3000 psi (20 MPa) or, utilizing the manual override, and gravity, to conserve air when lowering upper frame 12. In one embodiment, air tank 98 is a standard SCBA air cylinder typically used by fire and rescue services.

As shown by FIG. 3, the upper frame 12 further includes a pair of sidearm supports 30, 30' which are each rotatably mounted to respective side frame members 22, 22'. It is to be appreciated that the pair of sidearm supports 30, 30' rotate about an axis, which is offset from a central axis of each side frame members 22, 22'. Each sidearm support 30, 30' can rotate 180degrees from a vertically up position, as illustrated, to a vertically down position that is indicated by the dotted lines in FIG. 3.

In another embodiment, the upper frame 12 is a support platform for releasably receiving a multipurpose roll-in cot shown generally as 40 in FIG. 2. The upper frame 12 in this embodiment would be provided without the back and leg rests 26 and 28, and would be provided with mounting engagements to support multipurpose roll-in cots such as, for example, the types disclosed by U.S. Pat. No. 4,037,871, and PCT Application No. US01/45144 (WO0239944), references commonly assigned to Ferno Washington, Inc., the disclosures of which are herein fully incorporated by reference.

As best illustrated by FIG. 3, the lower frame 14 is generally rectangular, and has a set of swivel wheels 42 at each corner thereof. The wheels 42 may be conventional caster wheels with foot-operated locking mechanisms. The lower frame 14 comprises a pair of longitudinally extending side frame members 44, 44' separated by three transverse frame members 46, 46', and 46" provided at the loading end, an approximate midsection of the lower frame 14, and the trailing end, respectively.

The support mechanism 16 is an x-frame that includes a first pair of parallel legs 48, 48' and a second pair of parallel legs 50, 50'. Respective ones of the pairs of legs 48, 50 and 48', 50' are pivotally connected at an intermediate location by a pivot brace or connection 52. The upper frame 12 is pivotally connected to each of the first pair of legs 48, 48' by a pivot 54 (FIG. 1, and in which the pivots on both sides of the frame 12 are the same). The lower ends of the first pair of legs 48, 48' are pivotally connected to the lower frame 14 by a first slide member shown generally by 56.

With reference to FIG. 3, the first slide member 56 comprises linear bearings 58 slidably supported by longitudinally extending bearing supports or guide 60 and mounted to a bracket 61. If desired, linear bearings 58 and bracket 61 may be a unitary component. As illustrated, the guide 60 is mounted between the traverse frame members 46' and 46" of the lower frame 14. The lower ends of the first pair of legs 48, 48' are also pivotally mounted to bracket 61. The lower ends of the second pair of legs 50, 50' are pivotally connected to the leading traverse frame member 46 of the lower support frame 14 also by pivots 54 (FIG. 1). The upper ends of the second pair of legs 50, 50' are pivotally connected to the lower frame 14 by a second slide member shown generally as 62. The second slide member 62 comprises linear bearings 64 slidably supported by longitudinally extending bearing supports or guide 66, and a bracket 67 upon which the upper ends of the second pair of legs 50, 50' are pivotally mounted. The guide 66 is mounted between traverse frame members 68 and 68' of the upper frame 12.

The pneumatic lift mechanism 10 is also pivotally mounted between the second pair of legs 50, 50' and the first slide member 56. In the embodiment illustrated by FIG. 3, the lift mechanism 10 utilizes two pneumatic cylinders 70, 70'. The lower ends of the cylinders 70, 70' are pivoted off bracket 61 and move along with the first slide member 56. The upper ends of the cylinders 70, 70' are pivoted off a bar attachment 72 mounted offset from the second pair of legs 50, 50' above the pivot braces or connections 52. The offset bar attachment 72 provides a mechanical advantage at the beginning of the lift sequence, wherein testing shows that slightly less than 4 pounds of mechanical lift is needed per pound of patient. Accordingly, in one exemplary embodiment, based upon utilizing a pair of 2.5" pneumatic cylinders and about 200 psi (~1.3 MPa) of working pressure, the cot 2 is able to lift a patient weighing about 500 pounds (~228 kilograms). Optionally, as explained in a later section, the working pressure may be increased up to about 250 psi (~1.7 MPa) if necessary to lift a patient weighing about 600 pounds (~272 kilograms).

Arresting Device

Figure 4:
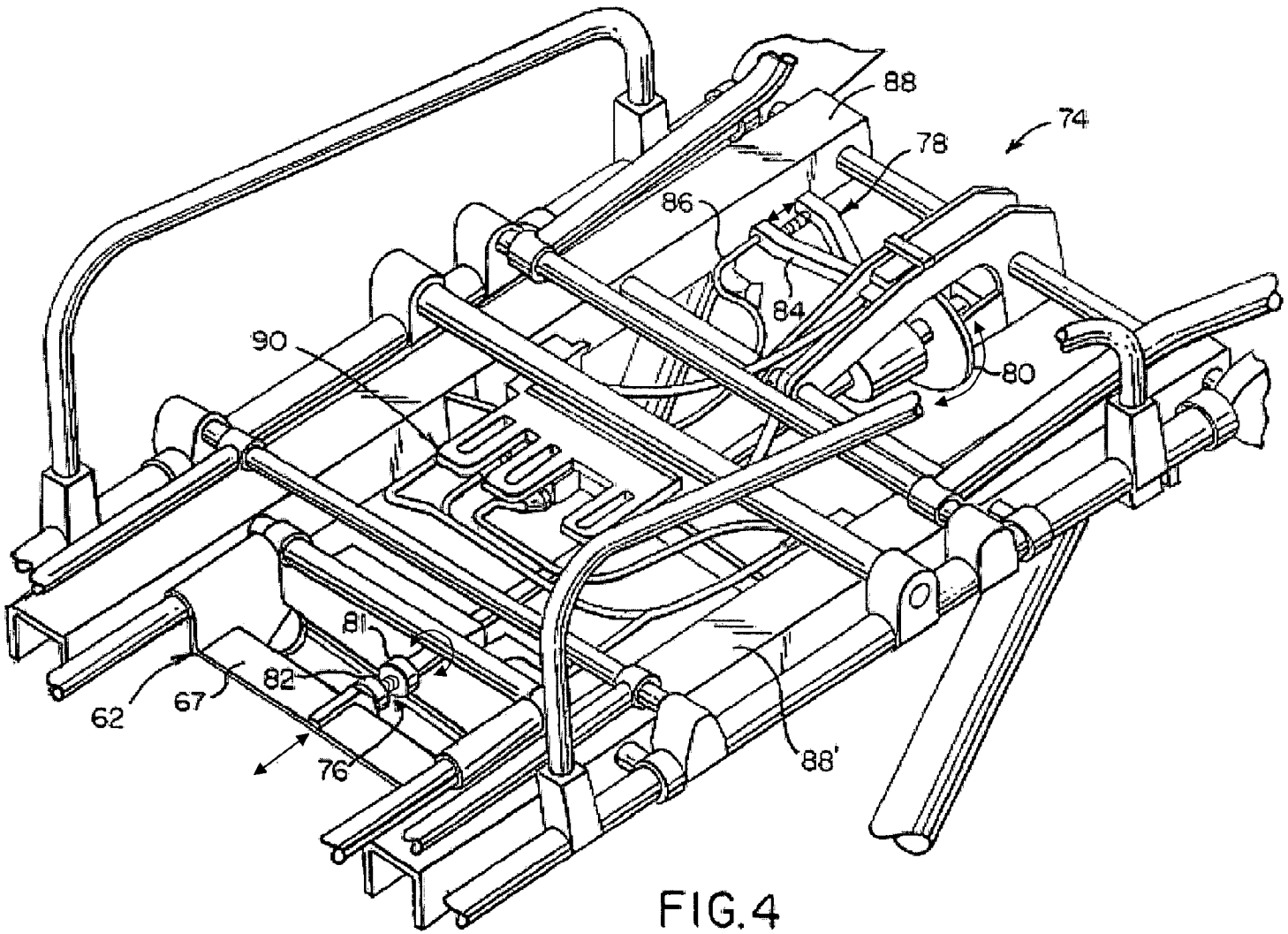
FIG. 4 is a close up schematic top view of the undercarriage of the cot depicted in FIG. 3 according to the invention.

The cot 2 is further provided with an arresting device shown generally as 74 in FIG. 3, which releasably arrests the movement of the second slide member 62. In the embodiment illustrated by FIG. 4, the arresting device 74 includes a ball screw 76 that is coupled to bracket 67 of the second slide member 62. A brake assembly 78 releasably engages a disc 80 mounted to a screw portion 81 of the ball screw 76 to permit rotation of both the screw portion and disc when unengaged and to prevent rotation when engaged. A tube/nut portion 82 of the ball screw is mounted to bracket 67 such that it may pivot vertically to prevent jamming under loading and unloading conditions. When the brake assembly 78 is unengaged, the tube/nut portion 82 of the ball screw 76 travels linearly with the second slide member 62 along the upper longitudinal linear bearing support bars as the pneumatic cylinders 70, 70' expand or contract. It is to be appreciated that the expansion and contraction of the cylinders 70, 70' will also cause movement of the first slide member 56. Movement of the first and second slide members 56 and 62 permits infinite adjustments to the vertical position of the upper frame 12 with respect to the lower frame 14.

Figure 4A:
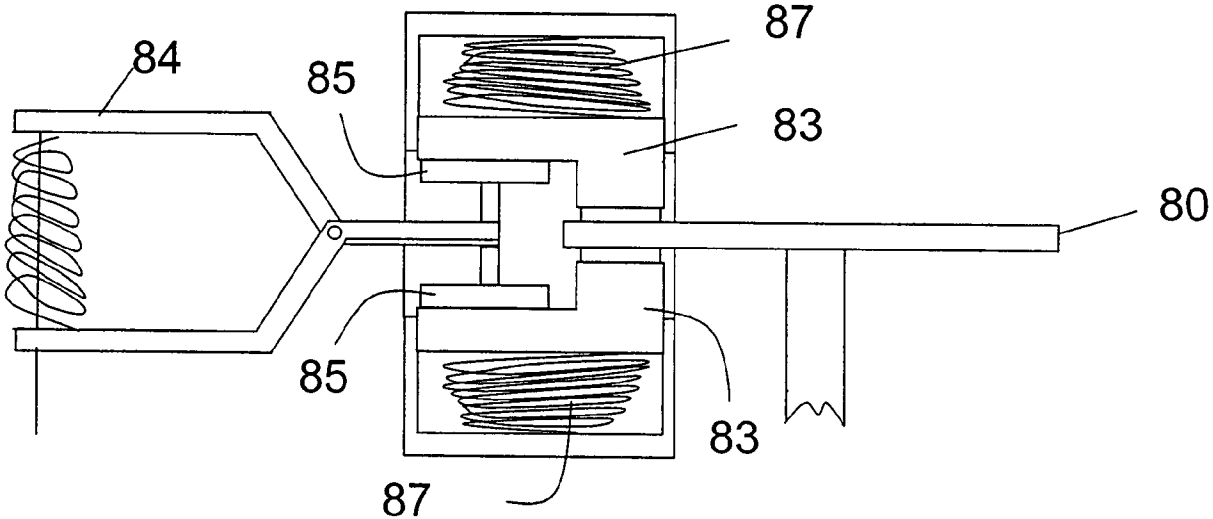
FIGS. 4A and 4B are diagrams of and illustrative embodiment of the braking assembly depicted in FIG. 4, with the normal brake engaged position shown by FIG. 4A, and the operated brake disengaged position shown by FIG.4B.
Figure 4B:
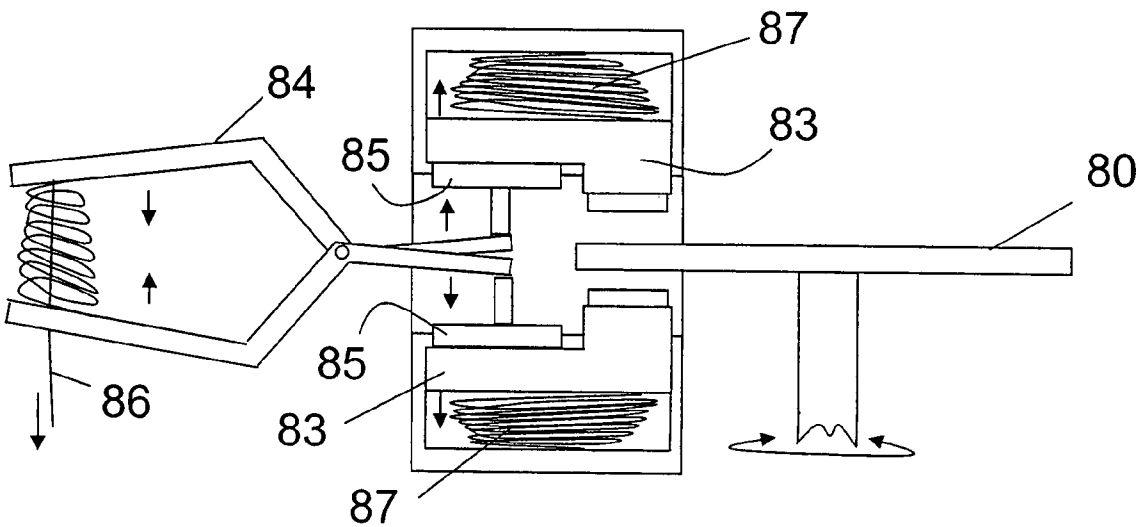

The brake assembly 78 is sized to permit a full lock-up of the ball screw 76 up to a desired torque limit, but slip if the torque exceeded that desired torque limit to prevent overstressing of the ball screw/clutch system. In the illustrated embodiment, best shown by FIGS. 4A and 4B, the brake assembly 78 further includes calipers 83 releasably engaging the disc 80, and an actuator 84. Appling pressure to the actuator 84, such as via a hand operated pull cable 86, forces pistons 85 against the calipers 83 separating the calipers and the disc 80 to maintain a running clearance therebetween. When pressure is removed from the actuator 84, springs 87 push the calipers 83 against the disc 80, clamping and locking the disc which prevents the screw portion 81 of the ball screw 76 from rotating and the second slide member 62 from traveling. The amount of pressure applied by the springs 87 controls the amount of torque. In one embodiment, the arresting device 74 has been tested to carry a tensile load as high as about 4000 pounds (~1818 kilograms) supporting a theoretical patient weighing about 700 pounds (~318 kilograms) at a position just above the lowered position.

Under powered-lift conditions, in one embodiment the ball screw 76 is released for rotation by a mechanical cable release 86 that operating the actuator 84. In another embodiment, the ball screw 76 is released for rotation by pneumatically operating the actuator 84 with the same air pressure sent to the lifting cylinders 70 to move the undercarriage up or down. For manual (back-up) mode the actuator 84 may be manually activated by the mechanical cable release 86 allowing manual height adjustments. In the manual mode, the mechanical cable release 86 would have the same function as conventional manually raised and lowered cot. In the event of a loss of air pressure, the spring-loaded brake assembly 78 stops the rotation of the ball screw 76 and holds the slide members 56, 62 and the support mechanism 16 in the position it was in at the moment of loss of air pressure. However, it is to be appreciated that the brake assembly 78 allows the slide members 56, 62 to decelerate to a stop rather than coming to an instantaneous dead stop. This feature makes the loss of air pressure much less harrowing for patient and operator alike. Secondly, the brake assembly 78 allows the cot 2 to be stopped at any position throughout the normal range of travel. The third advantage is that the cot 2 operates exactly like a normal manual cot when it is in the manual mode.

Air System

Figure 5:
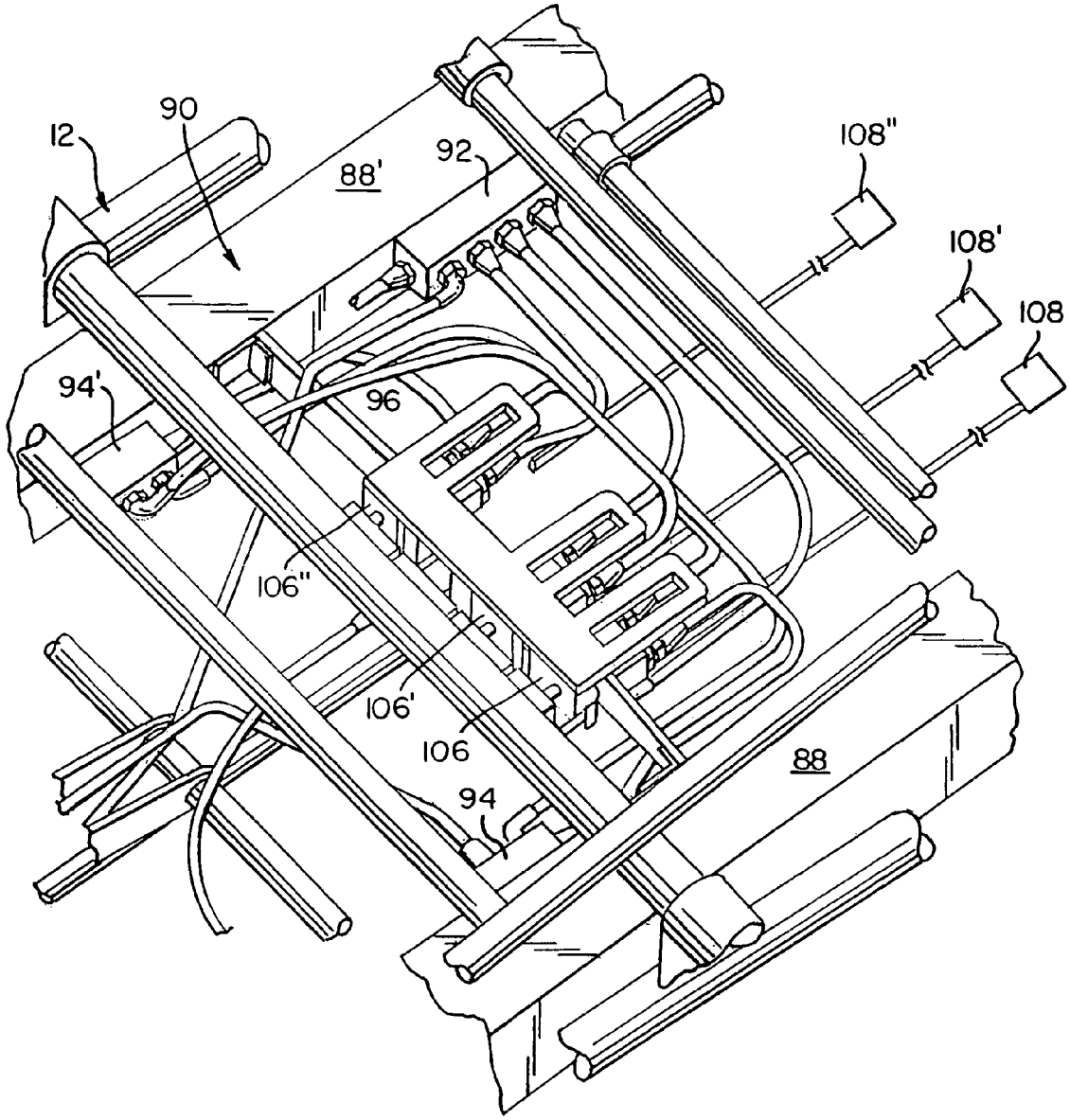
FIG. 5 is a close up schematic top view of the lift mechanism provided to the undercarriage of the cot depicted in FIG. 3 according to the invention.

Upper frame 12 has longitudinal strength members 88, 88' to provide additional support and rigidity to the upper frame. Mounted between strength members 88, 88' is a pneumatic valve system generally indicated by 90, which is best illustrated by FIG. 5. In the illustrated embodiment, the pneumatic valve system 90 includes a four-way air manifold 92 and a pair of three-way air manifolds 94, 94' operated by a set of control valves 96 as hereinafter described with reference to FIG. 6. In the illustrated embodiment the set of control valves 96 are labeled A-G, and are used to pressurize and exhaust either ends of pneumatic cylinders 70, 70'. Air tank 98 supplies pressurized air to manifold 94, and includes a regulator 100 to control the air pressure supplied to the pneumatic valve system 90.

Figure 6:
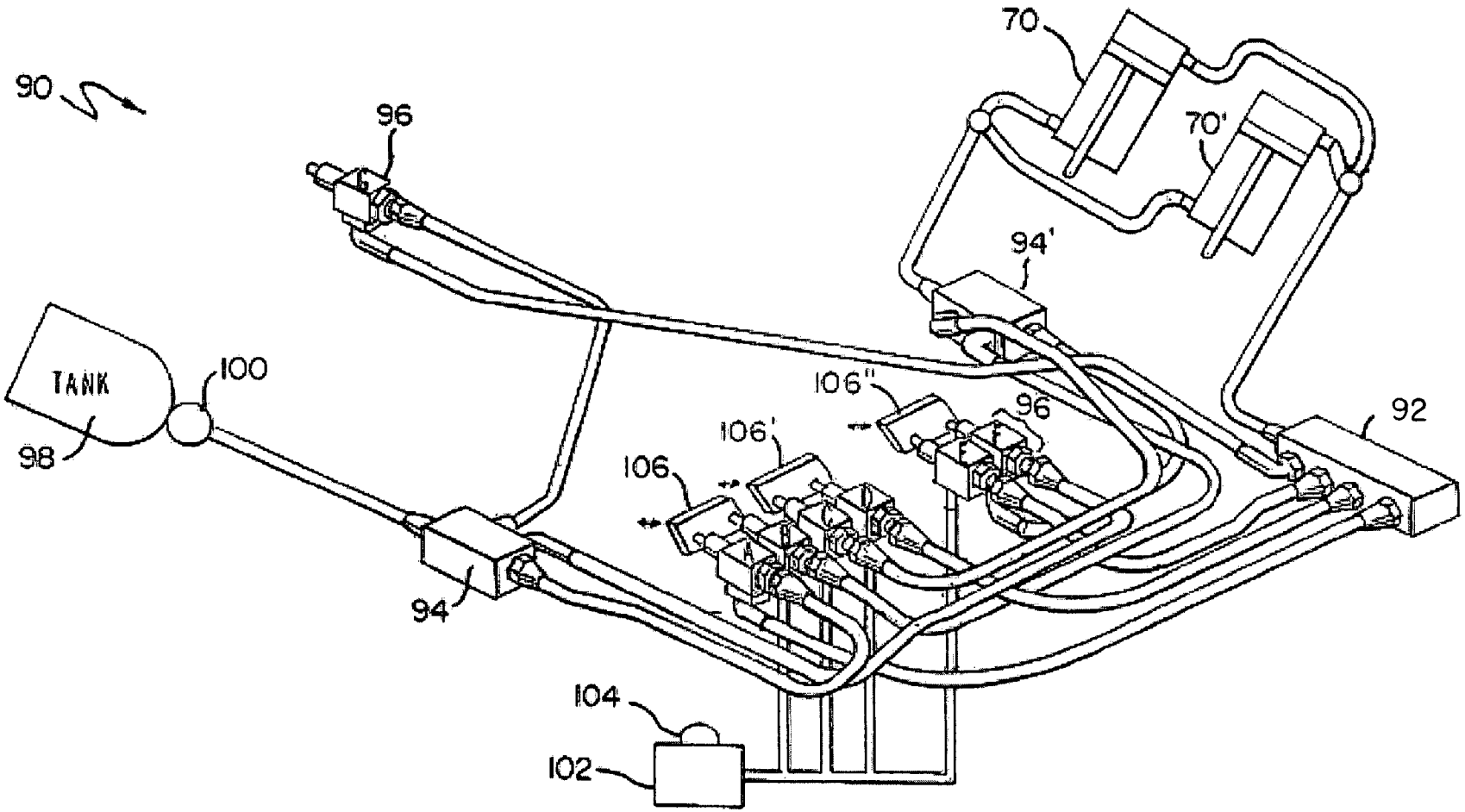
FIG. 6 is a schematic diagram depicting the pneumatic valve arrangement of the lift mechanism of the cot depicted in FIG. 3 according to the invention.

To pneumatically raise the upper frame 12 relative to the lower frame 14, actuating control valves A and B permits pressurized air to flow from air manifold 94 through control valve A through manifold 92 to the bottom of cylinders 70, 70'. As cylinders 70, 70' expand to lift the load on the cot, air in the top portion of cylinders 70, 70' is exhausted by flowing through both air manifold 94' and control valve B, thereby allowing the air to escape to atmosphere. To manually lower the cot 2, actuating control valves C and D allows all air in cylinder 70, 70' to escape to the atmosphere. To pneumatically lower the lower frame 14 relative to the upper frame 12, actuating control valves E and F permits pressurized air to flow from air manifold 94 through control valve F through manifold 94' to the top of cylinders 70, 70'. As cylinders 70, 70' contract, air in the bottom portion of cylinders 70, 70' is exhausted by flowing through both air manifold 92 and control valve E, thereby allowing the air to escape to atmosphere. Actuating control valve G permits pressurized air to flow from air manifold 94 through both control valve G and air manifold 92 to the bottom portion of cylinders 70, 70'. With regard to control valves B, C, D, and E, optionally, these valves may exhaust air to an exhaust manifold 102, which provides a muffler 104 to reduce the sound and force of the air exiting the system 90 to atmosphere. As illustrated by FIG. 6, three triggers 106, 106', and 106" are provided to actuate the sets of control valves 96. Trigger 106 actuates control valves A and B to raise the cot, trigger 106' actuates control valves C and D to manually lower the cot 2, and trigger 106" activates control valve E and F to pneumatically lower the lower frame 14 relative to the upper frame 12. Triggers 106, 106', and 106" are each operated by a respective hand-operated lever provided at the trailing end of the upper frame 12, which are indicated by symbols 108, 108', and 108" in FIG. 5. In this manner, a single operator may conveniently raise and load the cot 2 onto an elevated surface, such as the transport deck of an ambulance. It is to be appreciated that control valves C and D and trigger 106' are optional. It is also to be appreciated that the air system may be re-arranged to include any combination of air manifolds and triggers in order to provide the above described powered lifting and lowered, and optional manual lowering of the cot 2.

As illustrated by FIG. 6, three triggers 106, 106', and 106" are provided to actuate the sets of control valves 96. Trigger 106 actuates control valves A and B to raise the cot, trigger 106" actuates control valves C and D to manually lower the cot 2, and trigger 106" activates control valve E and F to pneumatically lower the lower frame 14 relative to the upper frame 12. Triggers 106, 106', and 106" are each operated by a respective hand-operated lever provided at the trailing end of the upper frame 12, which are indicated by symbols 108, 108', and 108" in FIG. 5. In this manner, a single operator may conveniently raise and load the cot 2 onto an elevated surface, such as the transport deck of an ambulance. It is to be appreciated that control valves C and D and trigger 106' are optional. It is also to be appreciated that the air system may be re-arranged to include any combination of air manifolds and triggers in order to provide the above described powered lifting and lowered, and optional manual lowering of the cot 2.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

We claim:

1. A pneumatically powered lift ambulance cot comprising:

a wheeled lower frame having a first slide member slidably supported by a longitudinally extending lower guide;

an upper frame having a second slide member slidably supported by a longitudinally extending upper guide, said upper frame is disposed above said wheeled lower frame;

a support mechanism which supports said upper frame relative to said wheeled lower frame, said support mechanism is pivotally connected to said upper frame, said wheeled lower frame, said first slide member, and said second slide member;

a pneumatic lift mechanism pivotally mounted at a first end to said first slide member, and at a second end to said support mechanism;

an air cylinder releasably mounted to said cot to supply air pressure to the pneumatic lift mechanism in order to assist relative movement between said upper frame and said wheeled lower frame; and an arresting device releasably arresting movement of said second slide member along said upper guide to permit adjustments of a vertical position of said upper frame with respect to said lower frame with or without assistance from the lift mechanism.

2. The pneumatically powered lift ambulance cot according to claim 1, wherein said upper frame forms a patient bed having an adjustable back rest, and said air cylinder releasably mounts to said back rest.

3. The pneumatically powered lift ambulance cot according to claim 1, wherein the first slide member comprises linear bearings slidably supported by the lower guide and mounted to a bracket upon which the lower ends of a first pair of legs of said support mechanism are pivotally mounted.

4. The pneumatically powered lift ambulance cot according to claim 1, wherein the second slide member comprises linear bearings slidably supported by the upper guide and a bracket upon which first ends of a second pair of legs of the support mechanism are pivotally mounted.

5. The pneumatically powered lift ambulance cot according to claim 1 wherein the first slide member comprises linear bearings slidably supported by the lower guide and mounted to a bracket upon which the lower ends of a first pair of legs of said support mechanism are pivotally mounted, and wherein the second slide member comprises linear bearings slidably supported by the upper guide and a bracket upon which first ends of a second pair of legs of the support mechanism are pivotally mounted.

6. The pneumatically powered lift ambulance cot according to claim 1, wherein said support mechanism is an x-frame that includes a first pair of parallel legs and a second pair of parallel legs, respective ones of the pairs of legs are pivotally connected at an intermediate location by a pivot brace.

7. The pneumatically powered lift ambulance cot according to claim 1, wherein said support mechanism is an x-frame that includes a first pair of parallel legs and a second pair of parallel legs, respective ones of the pairs of parallel legs are pivotally connected at an intermediate location by a pivot brace, and said lift mechanism is pivotally mounted at said second end to said first pair of parallel legs above each said pivot brace.

8. The pneumatically powered lift ambulance cot according to claim 1, wherein said support mechanism includes a first pair of elongated legs having a first end pivotally connected to said first slide member and a second end pivotally connected to said upper frame, and a second pair of elongated legs having a first end pivotally connected to said lower frame and a second end pivotally connected to said second slide member, respective ones of said first and second pairs of elongated legs being pivotally connected to one another each by a pivot connection.

9. The pneumatically powered lift ambulance cot according to claim 1, wherein the pneumatic lift mechanism comprises two pneumatic cylinders, wherein lower ends of the cylinders are pivoted off the first slide member and move said first slide member to adjust the vertical position between the upper frame and wheeled lower frame.

10. The pneumatically powered lift ambulance cot according to claim 1, wherein the pneumatic lift mechanism comprises two pneumatic cylinders, wherein lower ends of the cylinders are pivoted off a bracket of the first slide member and move said first slide member to adjust the vertical position between the upper frame and wheeled lower frame, and upper ends of the cylinders are pivoted off a bar attachment mounted offset from and above pivot connections between respective ones of pairs of parallel legs of said support mechanism.

11. The pneumatically powered lift ambulance cot according to claim 1, wherein the air cylinder supplies pressurized air to a pneumatic valve system, and includes a regulator to permit adjustment of the air pressure supplied to the pneumatic lift mechanism.

12. The pneumatically powered lift ambulance cot according to claim 1, wherein said arresting device comprises a brake assembly configured to arrest releasably movement of said second slide member.

13. The pneumatically powered lift ambulance cot according to claim 1, wherein the arresting device includes a ball screw coupled to the second slide member, and a brake assembly configured to releasably engage a disc mounted to a screw portion of the ball screw to permit rotation of both the screw portion and disc when unengaged and to prevent rotation when engaged.

14. The pneumatically powered lift ambulance cot according to claim 1, wherein the arresting device includes a ball screw coupled to the second slide member, and a brake assembly configured to releasably engage a disc mounted to a screw portion of the ball screw to permit rotation of both the screw portion and disc when unengaged and to prevent rotation when engaged, said brake assembly comprises a caliper configured to releasably engage the disc and an actuator configured to provide a running clearance between the caliper and the disc.

15. The pneumatically powered lift ambulance cot according to claim 14, wherein under powered lift conditions, the actuator is adapted to be pneumatically operated with the air pressure sent to the lift mechanism to move the upper frame up or down, releasing the disc for rotation.

16. The pneumatically powered lift ambulance cot according to claim 14, wherein the actuator is configured for manual operation which permits manual raising and lowering of the cot.

17. The pneumatically powered lift ambulance cot according to claim 1, wherein the lift mechanism includes a pair of pneumatic cylinders in fluid connection with a four-way air manifold, a pair of three-way air manifolds, and said air cylinder, said air manifolds being operated by a set of control valves.

18. The pneumatically powered lift ambulance cot according to claim 17, wherein actuating first and second ones of said control valves pneumatically raises the cot, optionally actuating third and fourth ones of said set of control valve manually lowers the cot, and actuating fifth and sixth ones of said set of control valves pneumatically raises the wheeled lower frame relative to the upper frame.

* * * * *